United States Patent [19]

Latasiewicz

[11] 4,345,119

[45] Aug. 17, 1982

[54] MEMBRANE SWITCH ASSEMBLY WITH IMPROVED SPACER

[75] Inventor: Leonard Latasiewicz, Hoffman Estates, Ill.

[73] Assignee: Motorola Inc., Schaumburg, Ill.

[21] Appl. No.: 236,073

[22] Filed: Feb. 19, 1981

[51] Int. Cl.[3] ..... H01H 13/04

[52] U.S. Cl. ..... 200/5 A; 200/159 B

[58] Field of Search ..... 200/5 A, 159 B, 86 R; 428/158

[56] References Cited

U.S. PATENT DOCUMENTS

| | | | |
|---|---|---|---|
| 3,718,791 | 2/1973 | Szablowski | 200/85 A |
| 3,829,632 | 8/1974 | Klehm, Jr. | 200/5 A |
| 3,860,771 | 1/1975 | Lynn et al. | 200/5 A |
| 3,898,421 | 8/1975 | Suzumura | 200/1.5 B |
| 3,920,940 | 11/1975 | Brown et al. | 200/86 R |
| 3,978,297 | 8/1976 | Lynn et al. | 200/5 A |
| 3,987,259 | 10/1976 | Larson | 200/5 A |
| 3,995,126 | 11/1976 | Larson | 200/5 A |
| 4,046,975 | 9/1977 | Seeger, Jr. | 200/5 A |
| 4,065,649 | 12/1977 | Carter et al. | 200/5 A |
| 4,143,253 | 3/1979 | Wagner et al. | 200/5 A |
| 4,158,115 | 6/1979 | Parkinson et al. | 200/5 A |
| 4,180,711 | 12/1979 | Hirata et al. | 200/5 A |
| 4,194,099 | 3/1980 | Mickelson | 200/5 A |

OTHER PUBLICATIONS

"Membrane Switches, Low-Cost Companion for Electronic Logic", J. K. Haggerty, Centralab, Inc., Milwaukee, Wisconsin, pp. 90–95, Machine Design, Apr. 10, 1980.

"Membrane Switches Function Reliably in Spite of Dirt, Grease and Spills", J. H. Kelly, W. H. Brady Co., Milwaukee, Wisconsin, pp. 60–62, Control Engineering, Jan. 1980.

*Primary Examiner*—J. V. Truhe
*Assistant Examiner*—Morris Ginsburg
*Attorney, Agent, or Firm*—Margaret Marsh Parker; James S. Pristelski; James W. Gillman

[57] ABSTRACT

A resilient spacer for use in a membrane switch assembly is formed of an open-cell, non-reticulated foam felt layer, allowing air from the space between the upper and lower switch contacts to move into the foam material surrounding the contacts when a switch contact is made. The switch contacts remain protected from atmospheric contamination regardless of whether the assembly is edge sealed or not.

5 Claims, 2 Drawing Figures

MEMBRANE SWITCH ASSEMBLY WITH IMPROVED SPACER

BACKGROUND OF THE INVENTION

This invention relates to the field of membrane switches and, more particularly, to the provision of a spacer element for a membrane switch which will allow air trapped beneath the top film to move to and from the switch areas during switch actuation or during changes in atmospheric conditions.

In prior art membrane switches, some structures have included upper contacts on a flexible membrane which are selectively pushed down by the operator's finger to contact corresponding contacts on a lower film or printed circuit board. Other structures have included an upper conductive member or film which is forced down to bridge or short together two or more contacts on the bottom member. Various means have been used to prevent unwanted contact, the most common being an insulating film such as the commercial product known as Mylar, with an aperture for each switch area. Since the spacer film is adhesively attached to the upper and lower layers having contacts thereon, the switch actuating force must work against the pressure of the air or other gas trapped between the contacts. In some cases, air was forced out of a contact area and beyond the adhesive and, since the air could not return, the contact layers tended to remain in permanent contact. This condition could occur after normal usage or after testing at elevated temperatures. Attempts have been made to let air flow from a depressed contact area to an undepressed area by providing channels in the spacer, or alternatively, in the upper or lower contact layers. These attempts either do not allow enough air to move quickly enough, or require special shaping of the top or bottom layer.

In a passenger-operated automobile seat cushion switch, a relatively thick apertures foam layer spaces two groups of common contacts until they are forced into contact by an occupant of the seat. Since the spacer of this switch is compressed over most of its area simultaneously in order for the contacts to touch, it must be made of the ordinary open-cell highly resilient foam. Since the contacts of this switch do not require a high degree of environmental protection, this material causes no problems.

In a membrane switch, very little, if any, resilience is required in the spacer, since only a small portion of the upper film layer is depressed to close a contact. Therefore, polyurethane "felts" were tested as spacers. A felt is made from a sheet of foam which is compressed between heated platens in order to achieve greater density and firmness. Other characteristics are changed little, if at all. Membrane switches have been designed using spacers made of open-cell reticulated foams, but when the switches were environmentally tested, it was determined that airborne contaminants could too easily reach the switch areas and cause corrosion of the contact surfaces. Closed-cell foam, on the other hand, provides some resilience when a contact area is depressed, but does not allow movement of air to and from the area and can also cause severe expansion problems under elevated temperature conditions. Attempts have been made to solve these compression and expansion problems by cutting channels into the foam layers connecting switch contact areas. While such channels solve a portion of the problem, foam layers cut in this way have proven to be difficult to handle during switch assembly.

SUMMARY OF THE INVENTION

It is, therefore, an object of the present invention to provide a spacer for a membrane switch assembly which will allow air to move from a switch area when the corresponding membrane area is depressed.

It is another object to provide such a layer which will also tend to prevent contamination of the contacts, and will allow operation at elevated temperatures.

These objects and others are provided in accordance with the present invention wherein a resilient foam spacer is made of an open-cell, non-reticulated foam felt material. The spacer is adhesively attached to a contact-bearing membrane on one surface and to a second contact-bearing member on the opposite surface. The spacer may be used in either flexible or rigid switch assemblies regardless of the contact configuration.

DETAILED DESCRIPTION OF A PREFERRED EMBODIMENT

Figure 1:
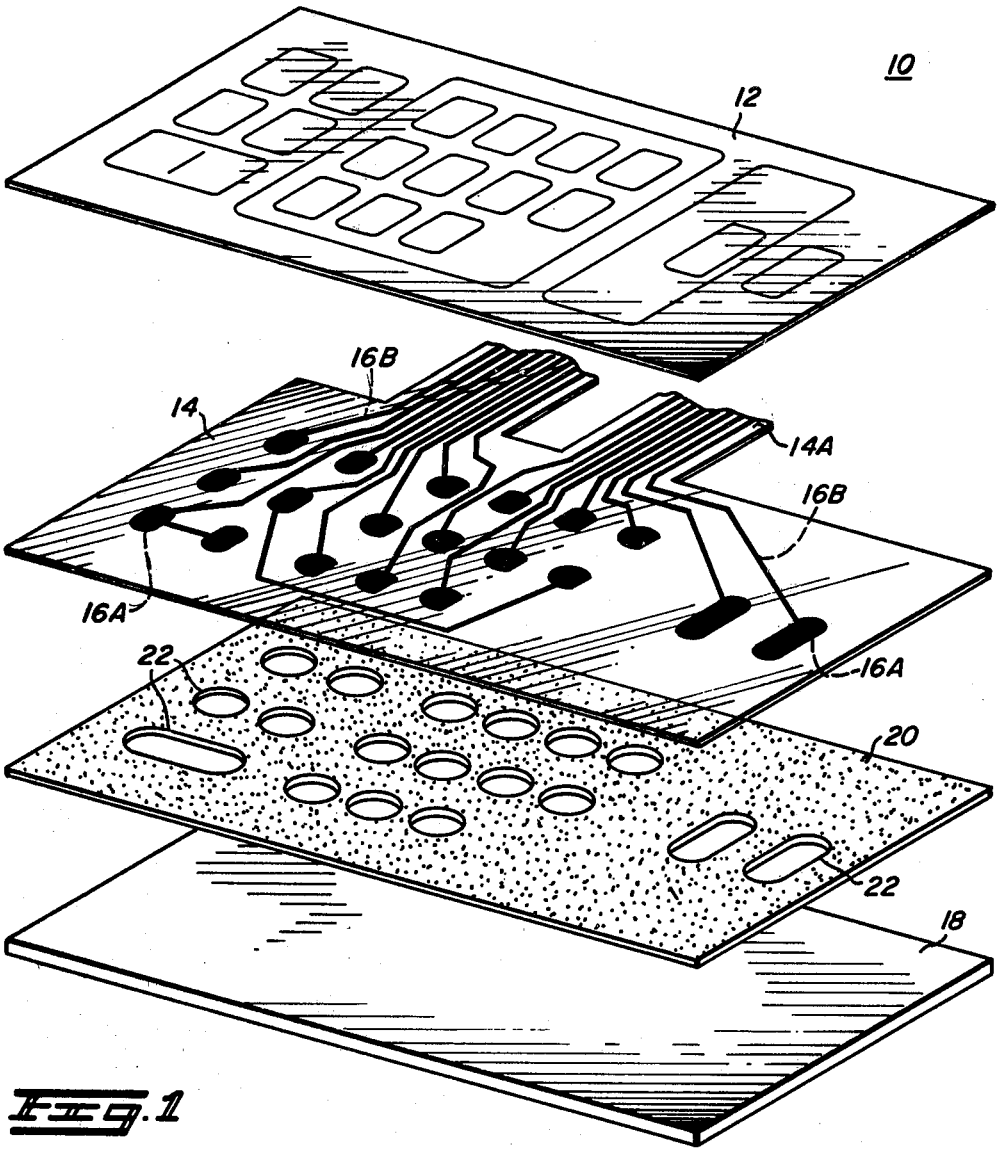
FIG. 1 is an exploded view of a switch assembly in accordance with the invention.

The membrane switch panel assembly 10 of FIG. 1 is only one possible assembly which could utilize the present invention. In this embodiment, there are four main members. A top film 12, which may be of the plastic sold commercially as Mylar, bears graphics or indicia relating to the functions controlled by the switch panel assembly 10. One application for such an assembly might be in the control panel of a microwave oven (not shown) where different cooking programs are to be programmed into the memory associated with the microprocessor. Programming is accomplished by touching the various panel areas so as to close switches in a sequence which corresponds to the desired cooking times and temperatures. The second member 14 may also be of Mylar and carries a printed pattern of conductors 16A and 16B on the underside. These conductors may be formed in any suitable fashion, but are preferably screen printed on using a coating made by Acheson Colloids Company. The coating is known as Electrodag 423SS ® and has graphite in a vinyl binder for resistances in the range of 30–50 ohms/sq. at 1.0 mil thicknesses. Each conductor includes at least one contact area 16A, forming one side of a normally-open SPST switch. A connector 16B joins each contact area with an external circuit (not shown) by way of an extended tab area 14A on the second film member. It will be apparent that the top film 12 and the second film 14 may be one single film bearing both indicia and contacts if so desired. The bottom member 18 of this assembly may be a metal plate or chassis, preferably terne plate for high corrosion resistance, and forming a common reference point or ground for all control panel switches of the assembly 10. The bottom member 18 could also be a thin film or printed circuit board bearing contacts. Positioned between the second film layer 14 and the bottom member 18 is a foam felt layer 20.

Figure 2:
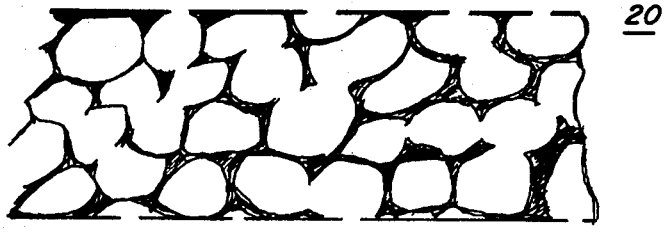
FIG. 2 is a cutaway view of a portion of the spacer layer of FIG. 1.

The resilient foam felt layer 20, shown in a cutaway view in FIG. 2 is preferably 0.03 in. thick (0.08 cm), has layers 12, 14 and has apertures 22 corresponding substantially to the switch contact areas 16A. As is known, the contact areas may be on the order of 0.5 in. (1.25 cm) in diameter for easy contact with the bottom plate 18 when the top film is depressed by the finger of the user. It has been determined, however, that users often use a sharp pointed instrument such as a pencil point or ballpoint pen in place of the fingertip. Such switch actuation tends to leave a small "dimple" in the top and second films. In prior art switch panels using an apertured plastic film as a spacer, such dimples could eventually cause unwanted contact in the individual switches especially in the more often used ones. Known plastic films in use are 3 mil Mylar or 5 mil cellulose acetate (used without adhesive), thus a dimple need not be large to cause a problem.

The spacer 20 has an adhesive layer (not shown) applied to each side for attaching to the second film member 14 and bottom member 18. The felt spacer material is preferably SCOTT Custom Felt, made by the Scott Paper Company and is made from an open-cell, non-reticulated, flexible polyester urethane foam which is hydrophobic and highly fungus-resistant. As defined in the foam maufacturing industry, "closed-cell" means that all cell walls are intact. "Reticulated" means that the foam material has been through a reticulation process which leaves only the skeletal web-like structure remaining. While the foam felt used here could well be described as "semireticulated" or "partially open", the nomenclature of the industry has been retained. The specific foam found to provide the best spacer layer characteristic is a 12 lb./cubic ft., 80 ppi (pores per linear inch) material with a firmness of 6, and from 20 to 30% of the cells open to another cell, though other ranges and values may be preferred in other embodiments. This material is very resilient yet dense enough to be relatively strong and shock absorbent, thus it is very easy to depress the layers 12 and 14 enough to make one of the contacts 16A touch the bottom member 18. Not only will the felt spacer 20 compress and self-restore when finger pressure is applied over a switch contact area, but the partially open pores or cells act as a reservoir to allow air to move from beneath the switch contact out into the immediately surrounding portion of the spacer, then return completely when finger pressure is removed. While a membrane switch using the felt spacer 20 can function fully after exposure to temperatures of 70° C., not enough pores or cells are open for moisture or other contaminants to find their way from the edge of the assembly through the foam layer to the switch contacts.

Thus, there has been shown and described an improved membrane switch having a non-reticulated foam felt spacer layer between the top switch contacts and the bottom contacts or common contact plate, allowing for easy actuation of the individual switches while protecting the assembly from contamination. The other assembly elements shown are to be considered exemplary only. It is intended to cover all modifications and variations of the present invention which fall within the spirit and scope of the appended claims.

What is claimed is:

1. A membrane switch assembly comprising a flexible upper member bearing a plurality of contact areas on a first surface and a bottom member including at least one contact area on a first surface thereof and a foam felt spacer including a plurality of apertures in registration with at least the contact areas on the upper member, and wherein said spacer is adhesively attached to the first surface of the upper member, and to the first surface of the bottom member, and is composed of a resilient, non-conductive, open-cell, non-reticulated foam felt material.

2. A foam felt spacer according to claim 1 wherein the spacer material is a polyester urethane foam.

3. A foam felt spacer according to claim 1 wherein the spacer material has a density of approximately 12 pounds per cubic foot.

4. A foam felt spacer according to claim 1 wherein the range of open cell walls is between 20% and 30%.

5. A foam felt spacer according to claim 1 wherein the spacer material has substantially 80 cells per linear inch.

* * * * *